US011220819B2

(12) United States Patent
Zhang

(10) Patent No.: US 11,220,819 B2
(45) Date of Patent: Jan. 11, 2022

(54) TRIPLE-LOCK MAIN TEE SPLICE

(71) Applicant: USG Interiors, LLC, Chicago, IL (US)

(72) Inventor: Hui Zhang, Buffalo Grove, IL (US)

(73) Assignee: USG INTERIORS, LLC, Chicago, IL (US)

( * ) Notice: Subject to any disclaimer, the term of this patent is extended or adjusted under 35 U.S.C. 154(b) by 0 days.

(21) Appl. No.: 16/816,315

(22) Filed: Mar. 12, 2020

(65) Prior Publication Data

US 2021/0285212 A1 Sep. 16, 2021

(51) Int. Cl.

| | |
|---|---|
| ***E04B 9/06*** | (2006.01) |
| ***E04B 9/10*** | (2006.01) |
| ***E04B 9/12*** | (2006.01) |

(52) U.S. Cl.

CPC ..... *E04B 9/068* (2013.01); *E04B 9/10* (2013.01); *E04B 9/122* (2013.01)

(58) Field of Classification Search

CPC ..... E04B 9/122; E04B 9/068; E04B 9/10
See application file for complete search history.

(56) References Cited

U.S. PATENT DOCUMENTS 3,565,474 A * 2/1971 Stumbo ..... E04B 9/10 403/219
3,898,784 A * 8/1975 Sauer ..... F16B 7/22 403/327
4,314,432 A * 2/1982 Rosenbaum ..... E04B 9/10 403/363
4,611,453 A * 9/1986 Worley ..... E04B 9/122 403/347
4,648,230 A * 3/1987 Mieyal ..... E04B 9/122 52/667
6,729,100 B2 5/2004 Koski et al.

OTHER PUBLICATIONS

Notification of Transmittal of the International Search Report and the Written Opinion, of the International Searching Authority, or the Declaration, International Search Report and Written Opinion of the International Searching Authority dated 167 Jun. 2021 for PCT/US2021/020789.

* cited by examiner

*Primary Examiner* — Adriana Figueroa
(74) *Attorney, Agent, or Firm* — Pearne & Gordon LLP

(57) ABSTRACT

An improved connector for a main tee of a suspended ceiling grid that has multiple locking elements that increase connection tensile force properties. The connector has an end tab with a forward portion bent at a lead angle and a receiving pocket with an outwardly flared entrance that, with an opposed identical connector, cooperate to provide smooth horizontal alignment. The end portion, additionally, includes an edge profile that vertically aligns itself with the receiving pocket of the opposed connector. The receiving pocket includes a spring-like resilient wall that limits the assembly force to overcome interference with projecting lock elements. The spring-like pocket wall and shape of the lock elements contribute to an audible click signaling that a connection has been completed. One of the lock elements works with a relief groove to augment self-alignment of the connectors.

8 Claims, 3 Drawing Sheets

TRIPLE-LOCK MAIN TEE SPLICE

BACKGROUND OF THE INVENTION

The invention relates to improvements in suspended ceiling grid components and, in particular, to end connectors for main runners or tees of such systems.

PRIOR ART

It is difficult to produce a main tee grid splice connector with previously known designs that is consistently easy to assemble in the field and that will result in a reliable and positive interconnection. Various known end connectors for main runners or tees can be somewhat difficult to install for numerous reasons. Such connectors may not be self-aligning and if they have provisions for self-alignment, their performance in this regard may be marginal at best. Smooth engagement and coupling between end connectors can be obstructed where the configuration of the connector parts have prominent surfaces or projections that interfere with the coupling advance of mating end connectors.

Typically, main runners are 12' long and are installed by a technician who, during an installation, grasps the runner, relative to the end being joined to a preceding runner, on the far side of its center. This permits proper balance and allows the technician to be in a suitable position to initially tie the runner up in suspended position. Thus, the technician is at least 6' away from the joint so that it is difficult for the technician to clearly see the end receiving pocket of the preceding runner. Moreover, from this location, the technician cannot cup the ends to be joined in one hand to align them together. Consequently, there remains in the art, a need for an end connection or splice system that affords self-aligning capability.

A more subtle but sometimes more troublesome problem occurs when the end connectors are out or nearly out of dimensional tolerance due to variations in material stock, tool wear or other manufacturing conditions. In this circumstance, the forces required to connect the ends of the runners may vary from one runner to the next so that the technician installing the grid is confounded by not knowing for sure if a good connection is being made. Additionally, these dimensionally marginal parts can require excessive assembly force, again to the distraction or frustration of the technician.

U.S. Pat. No. 6,729,100 discloses a main tee splice that has advanced the art and proven to be a consistently reliable product.

SUMMARY OF THE INVENTION

The invention provides a main tee splice connector of the type disclosed in U.S. Pat. No. 6,729,100 that affords a significant increase in tensile capacity. This increase in strength where the end connector is integral with the main part of the grid runner or tee enables the grid runner to perform at a higher rating or service duty than previously obtained. Conversely, with the integral splice of the present invention, previous service ratings can be obtained with lighter gauge material than has previously been used in the manufacture of main grid runners.

As disclosed, the basic configuration of the inventive splice connector is the same or similar to the prior art connector of U.S. Pat. No. 6,729,100. Consequently, the self-aligning and consistent performance attributes of the former design are retained. Additionally, the inventive new connector is compatible with the early connector thereby reducing or eliminating inventory and changeover problems. Additionally, the presently disclosed new connector affords a potential improvement in alignment between abutted main runners by virtue of an increased spacing of connector lock elements that can resist and/or reduce non-parallelism on a vertical plane at the splice joint.

In the illustrated embodiment, the end tab has elements for aligning itself to the receiving pocket of an opposed connector in both the vertical and horizontal directions. The vertical alignment feature is advantageously effective from a condition where the end tab misalignment is physically limited by the flange of the opposed tee runner. This structure enables a connection to be made where the end tab is first laid on the flange of the opposing previously installed runner and then is simply subjected to an endwise force by the installer. The leading profile of the end tab is effective, in the vertical location established by the flange of the opposed tee, to cam the end tab towards alignment with the mating connector. The vertical self-aligning character of the end tab is augmented by a lock lance element that registers with a groove in an opposed connector end tab. The vertical alignment action of the lock lance is assisted by horizontal alignment elements of the connector. The horizontal alignment elements of the connector comprise a lead angle formed by bending the forward portion of the end tab out of the plane of a main portion of the end tab and an outwardly flared entrance to the end tab receiving pocket. These lead angle and flared entrance elements provide relatively large, smooth caroming surfaces, as compared to edge areas, that improve the smooth functioning of the connector. The lead angle of the end tab and outward flare of the opposed connector are readily inter-engaged for horizontal alignment. Additionally, these lead angle and outward flare components avoid any direct edge-to-surface contact between these components so that smooth sliding action occurs when the lock lance moves out of the relief groove of the opposed connector in the late stages of the assembly movement where the potential interference between the connectors is greatest.

The disclosed connector is arranged to produce an audible click when a connection is completed and, therefore, signal the same to the installer technician. The repeatability and loudness of the click is the result of several structural elements of the connector. The lock elements have locking edges configured to snap over a mating edge of the opposed connector. The resilient character of the receiving pocket of the opposed connector imparts kinetic energy to the end tab when its lock elements snap over the locking edge of the opposed connector.

DESCRIPTION OF THE PREFERRED EMBODIMENT

Figure 1:
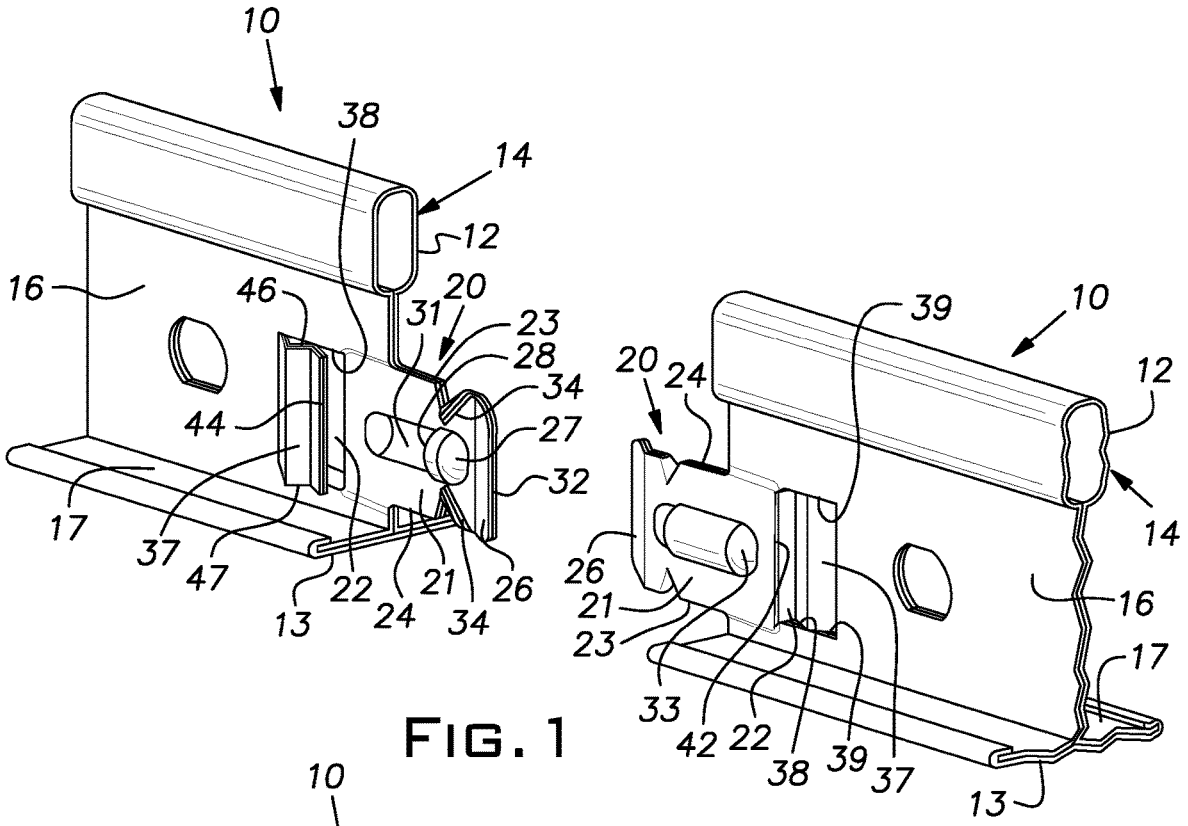
FIG. 1 is a perspective view of end portions of two main runners or tees shown prior to their endwise assembly or connection.
Figure 2:
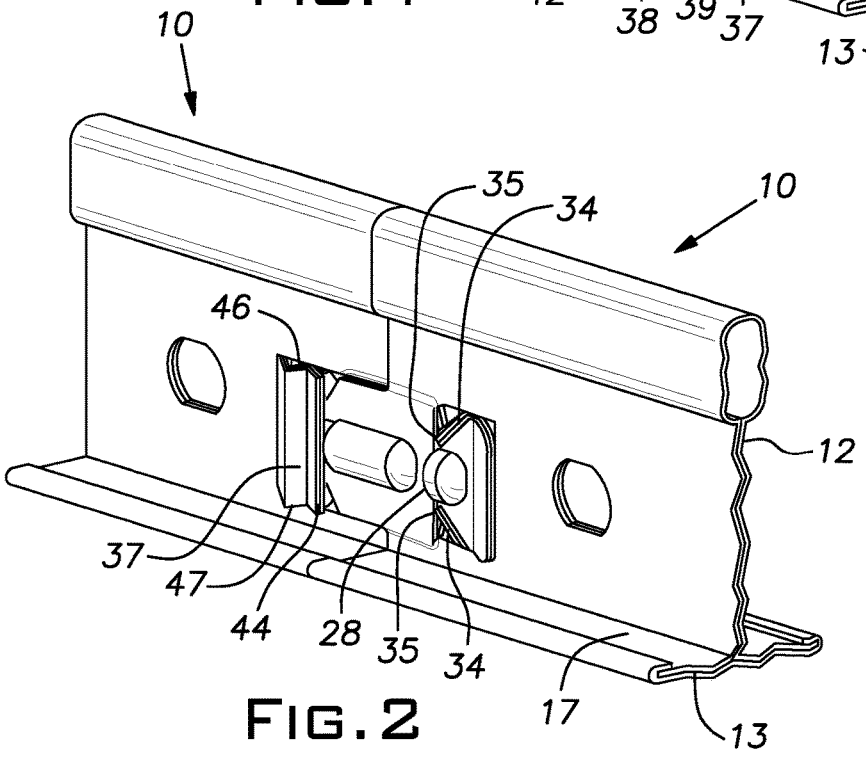
FIG. 2 is a perspective view similar to FIG. 1 but with connectors or splices of the main runners joined.
Figure 4:
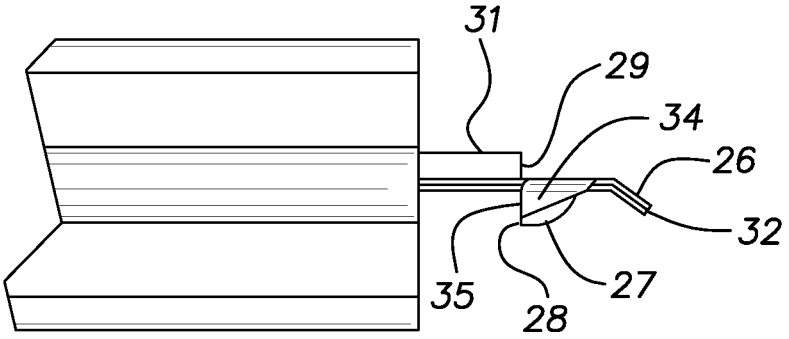
FIG. 4 is a plan view of a grid runner end and associated splice.

Referring now to the drawings, there is shown an end portion of a main runner or tee 10 of a general type commonly used for suspended ceiling grid systems as known in the art. Typically, such main runners or tees 10 are combined with cross runners or tees (not shown) to create a suspended grid work. In the illustrated example, the main tee 10 is made of two formed sheet metal strips 12, 13 typically of steel, although other material such as aluminum can be used. One of the strips 12 forms an upper hollow bulb 14, a double wall web 16, and oppositely extending flanges 17 all integral with one another. The strip 12 can have, for example, a thickness of 0.012" to 0.027" depending on the application. The other strip 13 lies under the flanges 17 and is wrapped around the distal edges of the flanges 17 to lock the strip 12 in its tee shape, conceal the seam between the flanges 17 and provide a smooth appearance for a lower face 18 of the tee 10; the lower face 18 of the strip 13 typically is painted for appearance purposes. The lower strip 13 is a suitable material, typically steel, but can be other materials such as aluminum. Holes (not shown) through the web 16 enable the tee 10 to be suspended by wire or other means as is known in the art. It will be understood that the runner 10 can have various other shapes, besides a conventional tee shape as is known in the art.

The runner or tee 10 has an end connector or splice 20 that, in the illustrated case, is integral with the web 16. It will be understood that certain features of the invention can be applied to connectors that are formed in a single web wall or layer or are formed wholly or partially as separate elements that are joined to the main parts of a runner with rivets or other means as is known in the art. As is conventional, a runner or tee 10 will have a connector 20 at each end.

The connector 20 includes an end tab 21 and an end tab receiving pocket 22 that, as explained below, cooperate with an identical connector in the manner of a "handshake" to connect the opposed ends of two aligned tees or runners 10 together. The end tab 21 and pocket 22 are die cut and formed by suitable stamping dies. The end tab 21 projects from an imaginary vertical plane perpendicular to the lengthwise direction of the tee 10 and located where the lower face 18 terminates, this location being the nominal end of the tee proper. Major or "land" portions of the end tab 21 are planar and are offset from the plane of the center of the tee 10 (where the walls of the web 16 abut) by a distance at least equal to the thickness of the stock forming the walls of the web (i.e. the thickness of one web wall). As will be understood, this will allow a face of an end tab 21 to mate with the face of another end tab substantially at the mid-plane of each of the tees 10 being joined or connected.

The side profile of the end tab 21 is generally rectangular having two parallel horizontal edges 23, 24 at the top and bottom, respectively. A plane of an end portion or lead angle 26 is at an acute angle of about 35 degrees, for example, from the plane of the end tab proper to the side of the tee 10 from which the end tab is offset.

Figure 3:
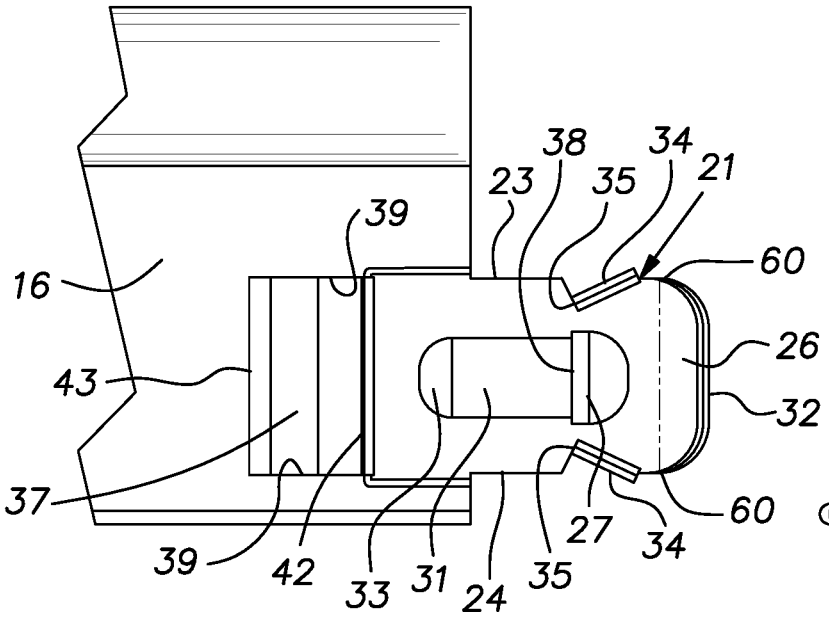
FIG. 3 is a side elevational view of a grid runner end and an associated connector or splice.
Figure 5:
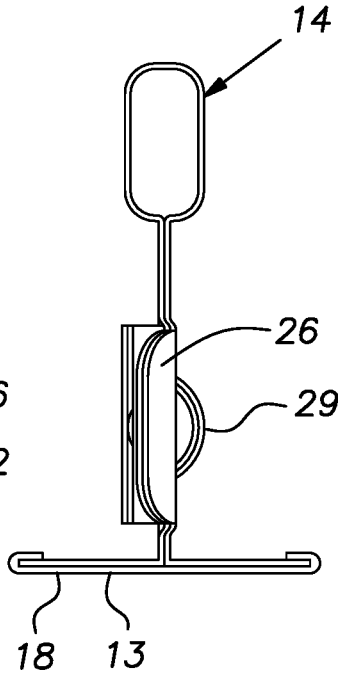
FIG. 5 is an end view of the splice.

A bulbous lock lance 27 is stamped into a forward area of the end tab 21 at mid-height of the end tab. The lock lance 27 projects from the plane of the end tab proper to the same side to which the lead angle end portion 26 is bent and from which the end tab is offset. The lock lance 27 is bulbous and preferably has the shape of a longitudinal half of a bullet. A locking edge 28 of the lance 27 is originally cut by a stamping die from a line common to an end edge 29 of a relief and alignment groove 31. The lock lance edge 28 is originally cut in the plane of the end tab proper on a line that is curved on a radius or radii centered away from the main tee proper, i.e. this cut line is convex with reference from the main tee proper. The result of this curved cut line geometry, when the lock lance is caused to protrude from the plane of the end tab proper, is that the free locking edge 28 forms an angle when viewed in a vertical direction as in FIG. 3 that is about 90 degrees or less. Thus, the apex or mid-point of the edge 28 furthest from the plane of the end tab proper is, ideally, situated at least as far back from a front edge 32 of the end tab 21 as remaining parts of this edge 28.

The relief groove 31 is vertically aligned with the lock lance 27 and extends longitudinally rearwardly from the lock lance to a somewhat rounded end 33 adjacent the receiving pocket 22. The relief groove 31 has a depth about equal or more than the height of the lock lance 27 and a width moderately larger than that of the lock lance.

Lock elements, each in the form of a triangular barb 34 are cut from both the upper and lower edges of the end tab 21. The barbs 34 are bent from the plane of the end tab 21 to project to the same side of the tab as does the lock lance 27. A rearwardly facing edge 35 of each locking barb 34 is preferably in an imaginary plane transverse to the length of the runner 10 and common to the rearward edge 28 of the lock lance 27.

Figure 7:
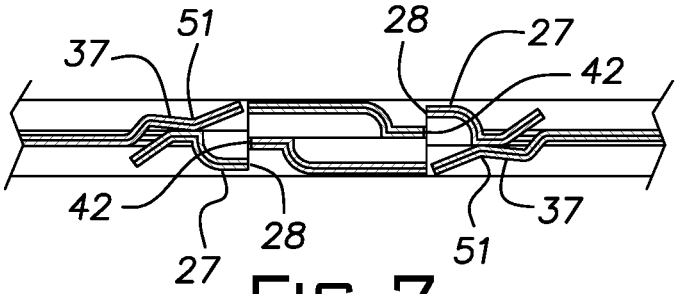
FIG. 7 is a cross-sectional view of the joined splices taken in the plane 7-7 in FIG. 6.
Figure 8:
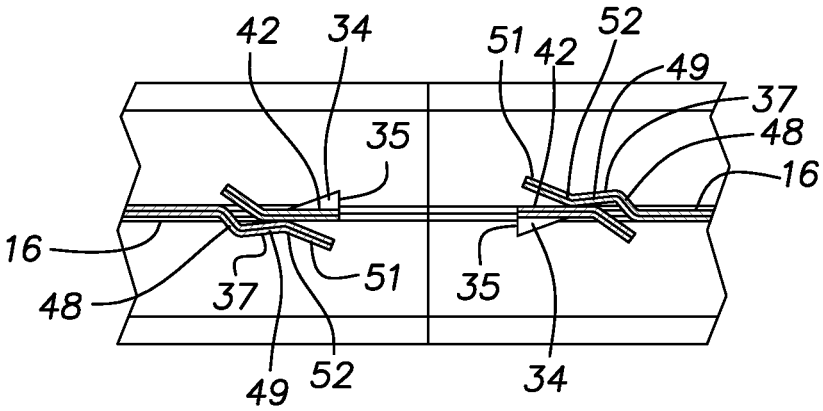
FIG. 8 is a cross-sectional view of the joined splices taken in the plane 8-8 in FIG. 6.

The tab receiving pocket 22 comprises a wall 37 and an opening 38. In the illustrated case, the wall 37 and opening 38 are rectangular and are produced by lancing or cutting the stock of the web 16 along parallel horizontal lines or cuts 39 and a vertical line or cut 42. The pocket wall 37 is integral with the web 16 along a side 43 proximal to the web 16 while the remainder including a distal edge 44 and top and bottom edges 46, 47 are cut free of the web. With particular reference to FIGS. 7 and 8, the wall 37 is stamped into a non-planar configuration that, for the most part, is spaced laterally outward of the web 16. In this context, the plane of the web 16 is defined as the space occupied by the web proper. A region of the wall 37 proximal to the web 16 forms a hollow by virtue of a step portion 48 bent away from the plane of the web 16 and an intermediate portion 49 bent slightly back toward the plane of the web. The distal end of the pocket wall 37 is formed with an outwardly flared portion 51 at an angle to the plane of the web 16. The wall 37, when viewed in FIGS. 7 and 8 is re-entrant at the zone of a bend line 52 between the outwardly flared portion 51 and intermediate portion 49 so that this zone 52 is exclusive in its proximity to the plane of the web 16 as compared to adjacent parts of the wall 37.

Figure 6:
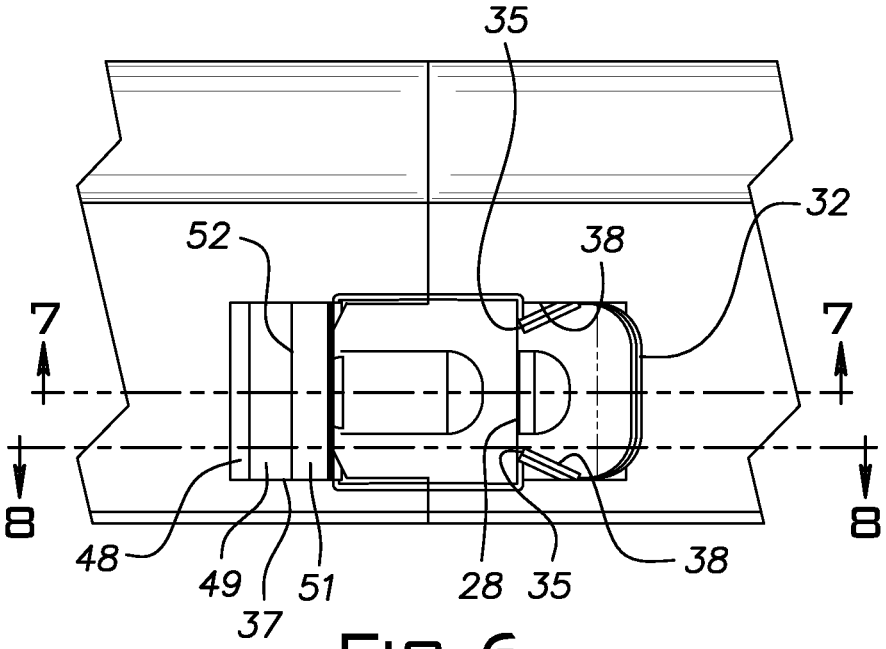
FIG. 6 is a side view of a pair of joined splices.

The connector 20 is adapted to mate with an identical connector as shown in FIGS. 6-8. In this manner, successive main tees or runners 10 are joined together end-to-end to span a room or other space in which a suspended ceiling is to be constructed. An important feature of the connector 20 is its ability to self-align itself to a mating connector. With the connector 20 urged horizontally or laterally towards the opposite connector, the lead angle end portion 26 slips into the pocket opening 38 of the opposed connector. Longitudinal force applied to the tee 10 being installed causes the inclined edge 60 working against the pocket opening edge 41 of the opposed connector to cam the connector 20 upwardly relative to the opposed connector and thereby self-aligns the connector to the opposed connector. Other shapes for the rounded edge parts 60, 61 capable of shifting the connector up or down when engaging the pocket structure are contemplated. This caroming action is augmented by two other caroming functions. Cam-like inter-engagement between the lead angle end portion 26 and the outwardly flared portion 51 of the pocket wall 37, at each set of these elements, biases the connectors 20 laterally or horizontally towards one another when the tees are forced axially or longitudinally towards one another. When the lock lances 27 inter-engage with the opposed relief grooves 31, these elements, in response to the lateral or horizontal bias developed by the sets of lead angle end portion 26 and pocket wall flare portion 51 cam the connectors 20 vertically, again in self-alignment action. The result of these combined caroming actions is that the connectors 20 are positively self-aligning and are comparatively easy to interconnect.

The relief groove 31 avoids significant interference between the connectors due to the projection of the lock lance 27 until after they have been effectively aligned by the end tabs 21 being substantially received in opposed pocket holes or openings 38. When the lock lances 27 reach the end 33 of the respective relief grooves 31 of their opposed connector 20 continued advance of the tee being installed requires the pocket walls 37 to momentarily resiliently deflect laterally outwardly to allow the lock lances to slide out of the ends of the grooves and over a short distance on the surface of the end tab proper until it passes the cut or edge 42 formed when the pocket wall 37 was made. Similarly, interference between the lock barbs 34 and end tab of the other connector is reduced by resilient deflection of the pocket walls 37. The re-entrant character of the wall 37 allows the surface area of the bend line 52 to exclusively contact the opposing end tab 21 and assures consistent spring action. At this point, the lock lance edges 28 and lock barb edges 35 under the influence of the spring-like force developed by the deflected resilient pocket walls 37 snap longitudinally behind the edge 42 of the opposed connector thereby completing a connection or splice. The edges 28 of the lock lance 27 and edges 35 of the lock barbs 34 engage the edge 42 of the pocket 22. Surprisingly, the lock barbs 34 despite engaging the same general connector area at the opening edge 42 of the opposite connector 10 as does the associated lock lance 27, double the tensile strength of the connector-to-connector splice joint. This tensile strength increase can allow a manufacturer of the main runners 10 to reduce the thickness of the metal sheet used for the runners, thereby advantageously reducing material cost.

A beneficial result of the disclosed structural features of the connector is that an audible click is produced when the lock lance edges 28 and lock barb edges 35 pass over the edges 42 of the pocket openings 38 allowing the end tabs 21 to snap against one another. The click signals the installing technician that a connection has been completed.

The lead angle end portions 26 and the flared portions 51 of the pocket walls ensure that only surface-to-surface contact occurs when the greatest interference arises in the connection sequence as the lock lances slide over opposed end tab surfaces. Contact between the front edge 32 of an end tab 21 or the distal edge 44 of the pocket wall 37 could greatly increase the frictional resistance between the connectors. In part, the re-entrant character of the wall at the bend line 52 avoids such edge contact. With the periphery of the pocket wall, specifically the edges 44, 46 and 47 (apart from where it is joined with the web proper), being free of connection with other parts of the connector, the pocket wall acts as a resilient spring. Consequently, the force to deflect it laterally for passage of the lock lances and lock barbs is limited. In turn, the force to effectuate a connection is moderate and not prone to vary widely when the connectors 20 are nearly out of tolerance because of material thickness variation, tool wear or other manufacturing conditions. Such wide variation is known to occur in prior art connector designs and is found to be very objectionable to professional installation technicians.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What is claimed is:

1. A splice connector on a main grid runner having a generally planar vertical web, the connector having a tab projecting longitudinally from the grid runner and having a vertical height extending along the vertical web, the tab having at least three locking elements including two barbs bent out of a plane of the web along lines at angles to a longitudinal direction distributed along the height of the tab, a pocket for receiving a tab of a substantially identical splice connector, the pocket having a retaining wall for laterally restraining the tab of the substantially identical splice connector and areas for interlocking with the at least three locking elements of the substantially identical splice connector.

2. A splice connector as set forth in claim 1, wherein the at least three locking elements include locking elements adjacent upper and lower edges of the tab.

3. A splice connector as set forth in claim 1, wherein said areas for interlocking are edges of open areas associated with said pocket.

4. A splice connector as set forth in claim 3, wherein said edges lie on a continuous straight line.

5. A splice connector as set forth in claim 1, wherein upper and lower locking elements of the at least three locking elements are triangular barbs cut from and bent out of the plane of the tab.

6. A connector for a runner in a suspended ceiling comprising an end tab and an end tab receiving pocket, the end tab having a lead end with an edge and the receiving pocket being rearward of the end tab, the end tab having a body with generally planar body portions rearward of the lead end, the material of the planar body portions defining a plane, the lead end being formed to one side out of the plane of said planar body portions, the end tab receiving pocket being proportioned to receive the lead end of an identical connector, the pocket having a wall lying in a zone lateral of the plane of the body portions, the end tab having at least three locking projections, including two barbs bent out of the plane of the planar body portions along lines at angles to a longitudinal direction projecting to a side of the tab to which the lead end is formed and each having a rearwardly facing locking edge, the connector having a receiving pocket for receiving the end tab, including the lead end, of an identical connector, the receiving pocket including rearwardly facing edge areas to interlock with the locking edges of the locking projections of the identical connector.

7. A connector as set forth in claim 6, wherein the end tab includes a relief area for receiving a locking projection of the at least three locking projections of an identical connector in assembly motion prior to full locking engagement with the identical connector.

8. A connector for a runner in a suspended ceiling comprising an end tab and an end tab receiving pocket, the end tab having a lead end with an edge and the receiving pocket being rearward of the end tab and having a wall, the end tab having a body with generally planar portions rearward of the lead end, the material of the planar body portions defining a plane, the end tab receiving pocket being proportioned to receive the lead end of an identical connector, the periphery of the wall being free of attachment from surrounding parts of the connector along a substantial portion of its length in the direction of the end tab whereby the wall operates as a resilient spring, the end tab including three laterally projecting lock elements each with a rearwardly facing locking edge, the lock elements including two barbs bent out of the plane of the planar body portions along lines at angles to a longitudinal direction, the connector having a receiving pocket for receiving the projecting lock elements of an identical connector including rearwardly facing edge areas to interlock with the rearwardly facing locking edges of the projecting lock elements of the identical connector, the wall being arranged to deflect as a spring a distance sufficient to enable the projecting lock elements of the identical connector to slide over areas of the end tab adjacent the rearwardly facing edge areas without excessive resistance.

* * * * *